United States Patent [19]

Mills et al.

[11] Patent Number: 4,508,247

[45] Date of Patent: Apr. 2, 1985

[54] STOPPER SUPPORT MECHANISM FOR CASTING CONTAINERS

[76] Inventors: Stephen D. Mills, 36 Grassington Rd., Beechwood Estate; Charles D. Brown, 24 Easson St., Grove Hill, both of Middlesbrough, Cleveland, England

[21] Appl. No.: 458,647

[22] Filed: Jan. 17, 1983

[30] Foreign Application Priority Data

Jan. 18, 1982 [GB] United Kingdom ..... 8201305

[51] Int. Cl.[3] ..... B22D 41/10

[52] U.S. Cl. ..... 222/598; 222/602; 222/148; 222/559

[58] Field of Search ..... 222/602, 597, 598, 603, 222/591, 559, 563, 594, 599, 148; 164/337; 251/250.5, 121, 122; 403/375, 354, 259, 4

[56] References Cited

U.S. PATENT DOCUMENTS

| | | | |
|---|---|---|---|
| 668,450 | 2/1901 | McFadden | 222/559 X |
| 2,587,110 | 2/1952 | Carter | 222/559 X |
| 3,200,457 | 8/1965 | Wagstaff | 222/597 X |
| 3,643,680 | 2/1972 | Hall et al. | 222/602 X |
| 4,155,492 | 5/1979 | Seaton | 222/602 X |

FOREIGN PATENT DOCUMENTS

| | | | |
|---|---|---|---|
| 825586 | 11/1951 | Fed. Rep. of Germany | 222/602 |
| 1960192 | 6/1971 | Fed. Rep. of Germany | 164/337 |
| 488298 | 7/1939 | United Kingdom | 222/602 |
| 834234 | 5/1960 | United Kingdom | 222/603 |
| 221232 | 1/1968 | U.S.S.R. | 222/602 |

*Primary Examiner*—Joseph J. Rolla
*Assistant Examiner*—Lawrence J. Miller
*Attorney, Agent, or Firm*—Abelman Frayne Rezac & Schwab

[57] ABSTRACT

A stopper for a casting machine is comprised of a hollow rod of a refractory material which is supported at its outer periphery by a clamp carried by a transversely extending arm, the transversely extending arm having a threaded end that extends through an elongated slot in a block carried by a vertically moveable support shaft, the transverse arm being securable to the block in a desired position of adjustment of clamping nuts.

5 Claims, 4 Drawing Figures

STOPPER SUPPORT MECHANISM FOR CASTING CONTAINERS

BACKGROUND OF THE INVENTION

This invention relates generally to support mechanisms for stoppers used in casting measured quantities of molten steel and is particularly concerned with the provision of an improved mechanism enabling accurate location of the nose of the stopper relative to the well of the nozzle of the associated casting container.

It is established practice to control the feed of molten steel from a container to a mold by means of an elongate stopper located vertically within the container and having a lower nose end co-operating with a nozzle in the base of the container whereby axial movement of the stopper relative to the container opens and closes the nozzle in accordance with the desired rate of flow of the molten steel.

In one known arrangement, the upper end of the stopper is rigidly connected to one end of a transverse connecting arm by means of a cylindrical rod. More particularly the lower extent of the rod is housed within the upper extent of the stopper to extend axially of the stopper, a pin extending diametrically through the stopper and the cylindrical rod to secure the stopper to the rod, while the upper, threaded extent of the rod extends through a slot in the one end of the transverse rod and is secured to said rod by a series of washers, nuts and lock-nuts both above and below said rod.

The other end of the transverse connecting arm is mounted to the upper end of a vertical shaft located outside the container, said upper end of the shaft being threaded and projecting through a receiving hole in the other end of the connecting arm to which it is connected by means of a series of washers, nuts and lock-nuts.

Integrally formed in the lower regions of the vertical shaft is a rack with which co-operates a rotatable pinion in such a manner that rotation of the pinion results in axially upward or downward movement of the shaft and attached components.

Thus it will be appreciated that there has been described a substantially inverted U-shaped support mechanism for the stopper which can be moved bodily upwards and downwards relative to the container to adjust the axial position of the nose end of the stopper relative to the nozzle and by which the stopper can be pivoted about the central vertical axis of the shaft to provide arcuate adjustment in a horizontal plane of the position of the nose end of the stopper relative to the nozzle.

Such arrangements suffer from a number of disadvantages. Not the least of these is that, although the axial position of the nose end of the stopper can be accurately determined, the precise location of the stopper nose end in a horizontal plane cannot, because the stopper can only be swung about a fixed vertical axis. For controlled casting it is essential for the central longitudinal axis of the stopper to be co-axial with, and form a continuation of, the central axis of the nozzle. Existing arrangements cannot ensure such a situation.

Further, the provision of a diametrical pin and the drilling of the stopper to receive the pin to enable the stopper to be secured to the one end of the connecting arm is a distinct mechanical weak-spot in the support mechanism and is extremely prone to breakage—once this part of the stopper breaks, the stopper becomes unsupported.

The stopper includes a central bore through which an inert gas such as argon can be fed to the nose end thereof during casting. Said gas, which amongst other things attempts to reduce the build-up of alumina and cold steel at the nozzle, is fed to the bore in the stopper by means of a radial passage provided in one of the above-mentioned washers incorporated in the means connecting the cylindrical rod to the transverse arm and to which washer is connected a supply of said gas. The nature of said connection means is such that the path of the gas from the supply to the bore in the stopper is very prone to leakage whereby substantial volumes of gas can be lost to atmosphere.

Substantial build-up of undesirable deposits in the nozzle can occur in the known arrangement despite the presence of the argon gas, and clearance is usually achieved by raising the container to disengage the nozzle from the mould, inserting a lance up the nozzle and feeding oxygen to the well of the nozzle through said lance. However this can often cause irrepairable damage to the nozzle with the result that the cast has to be aborted.

If oxygen were to be fed to the nozzle by way of the central bore in the stopper,—i.e. the argon feed path—the intense heat created would be such as to melt the pin securing the stopper to the cylindrical rod, thus causing the stopper to break away from its support mechanism.

It would be desirable to be able to provide a stopper support mechanism less prone to the above disadvantages and in particular mechanically stronger and more maneuverable than the known arrangement.

SUMMARY OF THE INVENTION

According to the present invention there is provided a stopper support mechanism for casting containers, the mechanism comprising an elongate stopper for substantially upright location within the container with its nose end adjacent a nozzle in the base of the container, a substantially upright support shaft for location externally of the container and movable axially relative to the container, a transverse connecting arm extending between the upper end of the stopper and the upper end of the shaft, first means connecting the stopper to one end of said transverse arm and second means connecting the other end of said transverse arm to the shaft, the first connecting means comprising a two-piece clamp gripping the upper regions of the stopper, one piece of said clamp being secured to said one end of the transverse arm, and location means reacting between the clamp and the upper regions of the stopper to locate the stopper axially within the clamp, and the second connecting means comprising a block member secured to the upper end of the shaft and having formed therein a slot through which extends the other end of the transverse arm in such a manner as to permit fore and aft movement and sideways movement of the transverse arm in the block member prior to securing the transverse arm to the block member in a desired position relative to the shaft.

Conveniently the stopper includes a central, axial bore extending the full length thereof, a gas supply pipe being sealingly connected to the upper end of, to form a continuation of, the bore in the stopper.

In a preferred mechanism, one half of the clamp is welded to the one end of the transverse connecting arm.

The location means may comprise one or more radial apertures formed in the upper regions of the stopper and a co-operating projection formed on the inside face of the clamp and received within the aperture or one of the apertures in the stopper.

Preferably the other end extent of the transverse arm is threaded, said threaded extent being received within, to extend through, the slot in the block member, the arm being secured in position relative to the block member by opposed nuts on the threaded extent of the arm reacting against opposed faces of the block member.

Conveniently the threaded extent of the transverse arm is provided with a pair of opposed flats thereon, the height of the slot in the block member being substantially equal to the distance between the flats on the arm whereby said flats and slot co-operate to prevent relative rotation of the arm and block member about the central longitudinal axis of the arm.

DESCRIPTION OF THE PREFERRED EMBODIMENT

Figure 3:
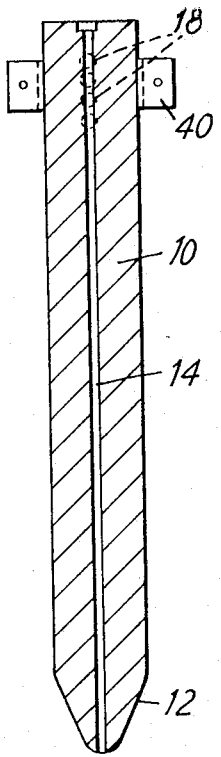
FIGS. 2 and 3 are sections on the lines II—II and III—III of the mechanism of FIG. 1.

Referring to the drawings there is shown a casting container or tundish 2 of conventional form having an outlet 4 in the bottom wall thereof for the molten steel. The outlet 4 includes a well-portion 6 and a nozzle 8 for location in the associated mould.

Located in an upright position within the container 2 is a stopper indicated at 10 of generally cylindrical form and including a rounded nose end 12 shaped to seat in the well 6 of the outlet 4 to close said outlet. A central bore 14 extends axially of the stopper the full length of said stopper, said bore extending from the flat upper surface 16 of the stopper 10 to exit at said nose end 12 of the stopper. A series of axially spaced, radially extending apertures 18 are formed in the upper regions of the stopper 10 for reasons which will become apparent.

A main support shaft for the stopper 10, of generally conventional form, is indicated at 20, said shaft being mounted in a support 22 secured to the container 2. The shaft 20 incorporates a rack 24 with which co-operates a pinion 26 rotatable by means of a handle 28 to enable, on appropriate movement of the handle 28, raising or lowering of the shaft 20 relative to the container 2 in conventional manner.

The stopper 10 is mounted to the shaft 20 through a mechanism including a transverse connecting arm 30, a two-piece clamp 32 and a block 34. More particularly, the arm 30 includes a main extent 36 of cylindrical form to the free end of which is welded one half 38 of the clamp 32. The other half of the clamp 32 is shown at 40 and has a cylindrical pin 42 formed on its inside face, said pin being shaped to be received in any one of the apertures 18 in the stopper 10.

When securing the stopper 10 to the arm 30, the clamp 32 is positioned to embrace the upper regions of the stopper 10 with the pin 42 received within an associated one of the holes 18 in the stopper dependent upon the desired axial position of the stopper 10 in the container 2. Bolts are then tightened to secure the two pieces of the clamp 32 together whereby the stopper 10 is securely fixed to the arm 30.

Figure 2:
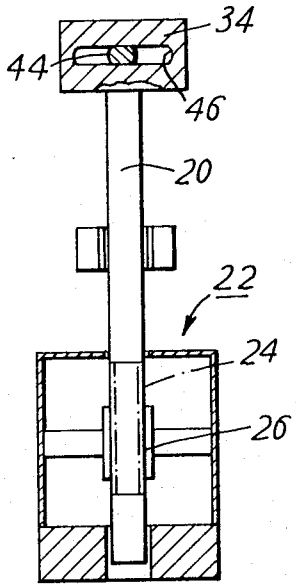
Figure 4:
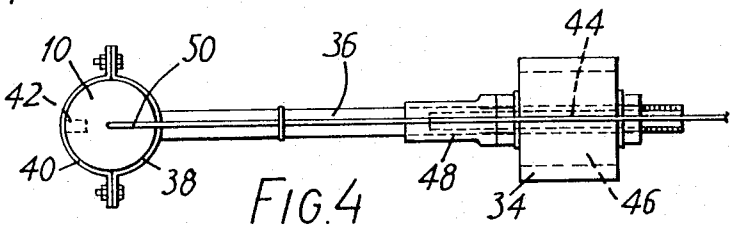
FIG. 4 is a plan view of the mechanism of FIG. 1.
Figure 1:
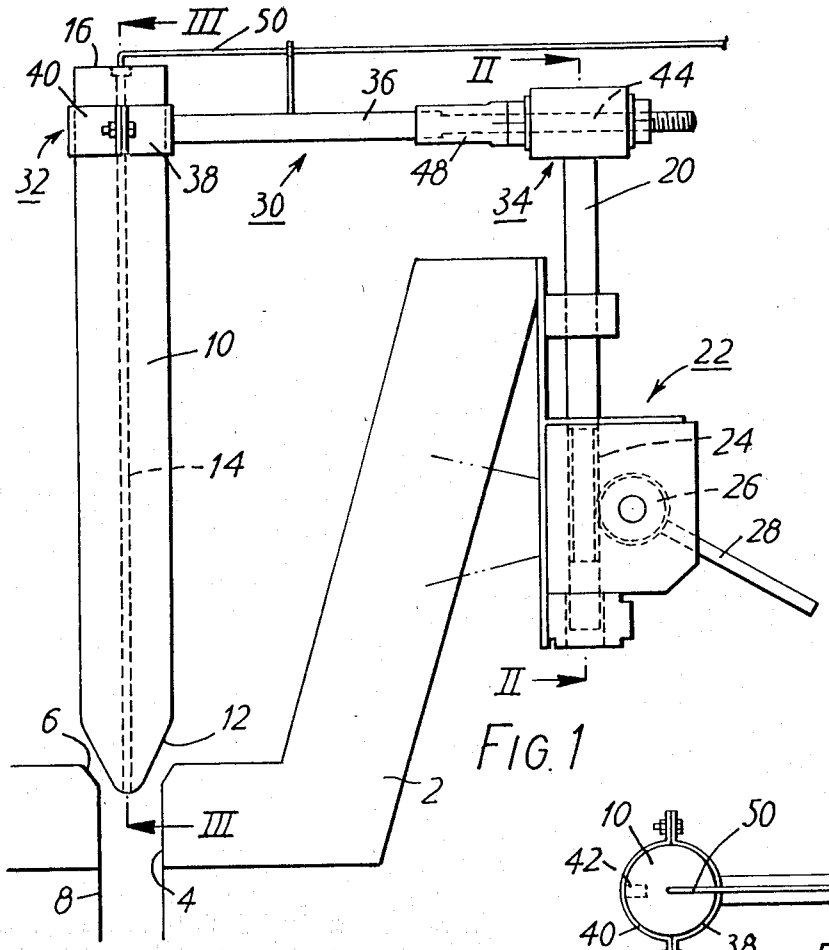
FIG. 1 shows a stopper support mechanism according to the invention.

The end of the arm 30 remote from the clamp piece 38 takes the form of a threaded extent 44 provided with a pair of opposed flats on the upper and lower surfaces of said extent 44. The block 34, which is of generally rectangular configuration, is welded to the upper end of the shaft 20 to be integral therewith and has a transversely elongate slot 46 formed therethrough extending fore and aft of the block considered in the longitudinal direction of the arm 30. FIG. 2 clearly shows the transverse extent of the slot 46, the height of which slot is substantially equal to the distance between the opposed flats on the extent 44 of the arm 30. Thus, the threaded extent 44 of the arm 30 can be passed through the slot 46 with the flats on the extent 44 co-operating with the upper and lower faces of the slot to prevent any relative rotation between the arm 30 and the block 34 about the central longitudinal axis of the arm.

The configuration of the slot 46 enables the arm 30 to be moved fore and aft of the block 34 and sideways in the block 34 before being secured relative to the block, whereby the location of the nose end 12 of the stopper 10 attached to the arm 30 can be accurately determined relative to the outlet 4. Once the desired position of the stopper is achieved, the arm is secured to the block 34 by means of washers, nuts and lock-nuts reacting between the arm 30 and the front and rear faces of the block 34, a sleeve 48, integral with one of the nuts, surrounding the threaded extent of the arm 30 to the side of the block 34 nearest the clamp 32 to prevent damage to said extent.

It will be appreciated that the stopper support mechanism described above is of extremely robust construction without any obvious weak points, unlike the known arrangements, and also permits very accurate positioning of the nose end 12 of the stopper 10 relative to the outlet 4. More particularly, the vertical position of the stopper 10 is determined by a combination of choice of location means 18,42 and by appropriate fine adjustment through the rack and pinion mechanism 24,26. The precise position of the nose end 12 in a horizontal plane can be achieved by appropriate fore and aft movement and sideways movement of the arm 30 in the slot 46 in the block 34, in combination with pivoting movement of the stopper 10, arm 30 and block 34 about the central axis of the shaft 20. Thus extremely accurate positioning of the stopper 10 such that its central axis is exactly aligned with the central axis of the outlet 4, which is essential for achieving satisfactory control of the flow of molten steel, can be achieved.

A gas supply pipe 50 is sealingly connected to the upper end of the bore 14 in the stopper 10. More particularly, the upper surface 16 of the stopper 10 is recessed to receive therein an annular washer welded or otherwise secured to the end of the pipe 50, said washer being retained in the top of the stopper by means of a refractory paste which effects a gas-tight seal between the pipe and the bore 14. Conveniently the pipe 50 includes a flexible extent to accomodate movement of the stopper 10.

During casting, and as is normal practice, inert argon is fed through the pipe 50 and bore 14 to the well 6 in an attempt, amongst other things, to minimise the build-up of alumina and cold steel. However such build-up does occur and can eventually cause blockage of the outlet 4.

In order to clear such a blockage, or to get rid of the undesirable deposits on the well 6, a supply of oxygen is attached to the pipe 50, the container 2 is raised so that the nozzle 8 is out of the associated mold, the stopper 10 is lowered so that its nose end 12 seats in the well 6 and oxygen is fed to the well via the bore 14. The oxygen reacts with the deposits to make them molten and so clear the outlet 4. Unlike the above-described known arrangement, there are no weak points in the arrangement of the invention, such as the diametrical pin connecting the stopper to the cylindrical rod, which can be affected by the heat build-up on said flushing with oxygen.

As well as locating the stopper 10 relative to the clamp 32, the provision of the pin 42—aperture 18 arrangement ensures that, should the pieces 38,40 of the clamp 32 inadvertently become loose, the stopper 10 does not immediately fall out of the clamp but is retained therein by co-operation between the pin 42 and associated aperture 18.

Thus there is provided a stopper support mechanism which is less prone to damage than known arrangements, which enables extremely accurate positioning of the stopper relative to the container outlet and which can prevent the build-up of alumina and cold steel between the nose end of the stopper and the well of the outlet. The consequential maintenance of a controlled gap between the stopper and the outlet enables more steel to be cast per container than heretofore. The stoppers have a longer working life, as has the container, saving on magnesite tiles and refractory materials. Less deskulling of the container is required and, together with the extra output through the same container, this results in less man-handling requirements.

What we claim and desire to secure by Letters Patent is:

1. A stopper and support mechanism for a casting machine of the type including:

a container having an outlet nozzle in its base;

a substantially upright support shaft located externally of the container and guided for axial movement;

a transverse connecting arm extending laterally from an upper end of said support shaft; and, an elongate stopper carried by said transverse connecting arm and supported within said container in substantially upright position in axial alignment with said nozzle:

the improvement comprising:

said stopper being of one piece and being comprised exclusively of a hollow rod of a refractory material having a gas transfer passage extending therethrough between its respective ends;

clamp means rigidly supported by said transverse arm and clampingly engaged with the external periphery of said stopper adjacent an upper end of said stopper, said clamp means providing the sole support for said stopper; and, adjustment means interposed between said transverse arm and said support shaft permitting orientation of the longitudinal axis of said elongate stopper relative to the longitudinal axis of said outlet nozzle.

2. The stopper and support mechanism of claim 1, further including:

as least one projection provided internally of said clamp means and which is received in a complementary recess in the external periphery of said stopper, said projection inhibiting axial movement of said stopper relative to said clamp means.

3. The stopper and support mechanism of claim 1, in which said adjustment means comprises:

a block member secured to the upper end of said shaft and having an elongate slot therein through which said transverse arm extends, said slot being of an extent sufficient to permit fore and aft movement and also lateral movement of said transverse arm within said slot; and, means for securing said transverse arm to said block in a selected position of adjustment of said transverse arm.

4. The stopper and support mechanism of claim 1, in which that end of said transverse arm that extends through the slot of said block is externally threaded, said transverse arm being secured to said block in its desired position of adjustment by opposed nuts threaded onto said transverse arm and which react against opposed faces of said slotted block member.

5. The stopper and support mechanism of claim 4, in which said threaded portion of said transverse arm is provided with a pair of opposed flats thereon, the height of the slot in the block member being slightly greater than the distance between the flats on the arm, whereby said flats and slot co-operate to prevent rotation of the arm relative to the block member about the central longitudinal axis of the arm.

* * * * *